US009951460B2

(12) United States Patent
Boulduan et al.

(10) Patent No.: US 9,951,460 B2
(45) Date of Patent: Apr. 24, 2018

(54) DISPENSING ARRANGEMENT FOR A HOUSEHOLD APPLIANCE FOR THE CARE OF LAUNDRY ITEMS AND HOUSEHOLD APPLIANCE FOR THE CARE OF LAUNDRY ITEMS

(71) Applicant: BSH BOSCH UND SIEMENS HAUSGERÄTE GmbH, München (DE)

(72) Inventors: Edwin Boulduan, Berlin (DE); Andre Sabalat, Berlin (DE); Marcel Werner, Berlin (DE)

(73) Assignee: BSH Hausgeräte GmbH, Munich (DE)

( * ) Notice: Subject to any disclaimer, the term of this patent is extended or adjusted under 35 U.S.C. 154(b) by 616 days.

(21) Appl. No.: 14/367,769

(22) PCT Filed: Dec. 18, 2012

(86) PCT No.: PCT/EP2012/075870

§ 371 (c)(1),
(2) Date: Jun. 20, 2014

(87) PCT Pub. No.: WO2013/092537

PCT Pub. Date: Jun. 27, 2013

(65) Prior Publication Data

US 2015/0114045 A1 Apr. 30, 2015

(30) Foreign Application Priority Data

Dec. 21, 2011 (DE) ..... 10 2011 089 395

(51) Int. Cl.
*D06F 39/02* (2006.01)

(52) U.S. Cl.
CPC ..... *D06F 39/022* (2013.01); *D06F 39/02* (2013.01)

(58) Field of Classification Search
CPC ..... D06F 39/022; D06F 39/02
See application file for complete search history.

(56) References Cited

U.S. PATENT DOCUMENTS

2009/0053119 A1* 2/2009 Richman ..... D06F 39/02 422/300

FOREIGN PATENT DOCUMENTS

| | | |
|---|---|---|
| DE | 19757303 | 6/1999 |
| DE | 297 24 890 | 5/2005 |
| DE | 10 2004 060709 | 6/2006 |
| DE | 10 2006 029953 | 1/2008 |

OTHER PUBLICATIONS

International Search Report for PCT/EP2012/075870, dated Jun. 18, 2013.
Final Office Action issued in related U.S. Appl. No. 14/367,664, dated Sep. 14, 2016, 18 pages (including PTO-892 citing Hilebrand, U.S. Pat. No. 5,588,313, dated Dec. 31, 1996).

* cited by examiner

*Primary Examiner* — Spencer E Bell
(74) *Attorney, Agent, or Firm* — Nixon & Vanderhye P.C.

(57) ABSTRACT

A dispensing arrangement for a household appliance for the care of laundry items includes a dispensing tray having an upper part connectable to a lower part. A water inlet flow device with a water-receiving depression is formed in the lower part and an outlet flow connection opening into the water receiving depression is formed on the lower part. The lower part has a partial channel of an extract ventilation channel, the partial channel opening into the outlet flow connection.

13 Claims, 3 Drawing Sheets

DISPENSING ARRANGEMENT FOR A HOUSEHOLD APPLIANCE FOR THE CARE OF LAUNDRY ITEMS AND HOUSEHOLD APPLIANCE FOR THE CARE OF LAUNDRY ITEMS

This application is the U.S. national phase of International Application No. PCT/EP2012/075870 filed 18 Dec. 2012 which designated the U.S. and claims priority to DE Patent Application No. 10 2011 089 395.4 filed 21 Dec. 2011, the entire contents of each of which are hereby incorporated by reference.

The invention relates to a household appliance for the care of laundry items, having a dispensing tray and a tub which is connected with the dispensing tray by way of an inflow section, in which case a vapor trap device is formed in a curved line segment in the inflow section.

A washing machine having a controllable fresh water feed for at least two detergent chambers is known from DE 10 2006 029 953 A1. A detergent dispensing device is arranged in an upper region of the housing of the washing machine. Detergent delivery lines discharge downwards from an unevenly formed base of the housing of said detergent dispensing device to the inlet to a sleeve on one side and to the inlet to a tub on the other side.

A supply ventilation of the tub without an additional supply ventilation line is also provided by said detergent dispensing device, and on account of the two separate detergent delivery lines and their connection to the unevenly formed base of the housing of this detergent delivery device one of said two lines is guaranteed to always be unoccupied.

A dispensing arrangement having a water inlet for a washing machine is known from DE 10 2004 060 709 A1. A dispensing tray of the dispensing arrangement is designed with an upper part and a lower part, in which case the lower part has an outflow connection and a depression as a water supply. A separating wall which divides the lower part in conjunction with the water contained in the depression and the water seal formed thereby into two spaces separate from one another protrudes from above into the water contained in the depression. The separating wall is formed in one piece on the lower part or preferably with the upper part. This means that the components are very complex and difficult to manufacture, in particular if they are designed as injection molded parts.

DE 197 57 303 A1 also discloses a dispensing arrangement having an outflow connection, in which the one extract ventilation channel is formed as an integral component of the outflow connection.

The object of the present invention is to create a dispensing arrangement and a household appliance for the care of laundry items, wherein on the one hand a compact construction of a liquid dispensing facility and on the other hand a supply ventilation is achieved and manufacturing is simplified, wherein condensation of the gaseous medium is enabled by means of the supply ventilation.

This object is achieved by a dispensing arrangement and a household appliance according to the independent claims.

A dispensing arrangement according to the invention for a household appliance for the care of laundry items comprises a dispensing tray which has a lower part, wherein a water inlet flow device having a water-receiving depression is formed in the lower part and an outflow connection opening into the water-receiving depression is formed on the lower part. The lower part has a partial channel, opening into the outflow connection, of an extract ventilation channel integrated in the dispensing tray. As a result of such an embodiment of the dispensing tray it is possible to achieve on the one hand a highly integrated system of a vapor trap and on the other hand of a corresponding supply ventilation. In the context of the invention a vapor trap is understood to be an essentially U-shaped pipe system, wherein the pipe runs of the pipe system communicating with one another can be filled with a liquid medium to a level such that no through-flow of gaseous medium is enabled. The vapor trap is effective when the pipe system is filled up to this level. The pipe system can also have a form differing from the U-shape provided that the pipe runs of the pipe system communicating with one another can provide such a vapor trap having the same effect.

Provision is furthermore made that the partial channel is delimited by a wall which is also a delimiting wall of a water-receiving compartment of the dispensing tray. The compact design is thereby facilitated. In particular, an especially noteworthy variant is however thereby achieved with regard to the condensation of the gaseous medium carried by way of the extract ventilation channel.

By preference, the dispensing tray furthermore has an upper part which can be connected with the lower part. Such a connection can for example be provided by means of corresponding locking and/or screw fastening devices. The upper part and lower part can also be connected by means of material bonding. The material bonding can be provided by welding, adhesive bonding or by means of injection molding methods. The upper and lower parts can thereby be provided as a single part.

Provision is preferably made that the partial channel is essentially formed over the entire length of a water-receiving compartment of the dispensing tray in the lower part.

In particular, provision is made that the partial channel is closed by a second partial channel in the upper part when the lower part is connected with the upper part.

In particular, provision is made that the extract ventilation channel is routed from a front end of the lower part, at which the outflow connection is arranged, to a rear end of the lower part and upwards into the upper part and from there again to the front end opening into a discharge opening. By this means a particularly long path is achieved in the dispensing tray for the gas stream which is in particular routed by way of a particularly long path along the water-receiving compartment. The desired condensation is thereby particularly facilitated.

Provision is preferably made that a separating wall separate from the lower part is formed, which can be fitted to the lower part, and in the disposed state of the separating wall a siphon is formed between the outflow connection and the water-receiving depression.

Provision is preferably made that the upper part has a guide wall, by means of which, when the upper part is in the assembled state with the lower part, the interior space of the dispensing tray is divided into two dispensing channels.

In particular, provision is made that a first dispensing channel is formed with the water inlet flow device as a vapor trap.

By preference, a second dispensing channel is formed with the water inlet flow device as a connection to a tub of the household appliance.

A separating wall separate from the lower part is preferably formed, which can be fitted to the lower part, and in the disposed state of the separating wall a siphon is formed between the outflow connection and the water-receiving depression. As a result of such a design the single-part production of the lower part is simplified and more cost-effective. Particularly with regard to production as an injection molded part the embodiment and design of a siphon are extremely difficult and prone to errors. By quasi producing and making available the separating wall independently and as a separate component and locating it only at a later point.

It is particularly advantageous if the separating wall can be fitted on the lower part in locking fashion. A very rapid and accurate assembly is thereby enabled, in which case the separating wall can then also be removed simply again.

The invention furthermore also relates to a household appliance for the care of laundry items, in particular a washing machine or a washer-dryer, which has a dispensing arrangement according to the invention or an advantageous embodiment thereof.

A preferred household appliance for the care of laundry items comprises a dispensing tray and a tub which is connected with the dispensing tray by way of at least one inflow section. In particular liquid medium, in particular detergent and water, is delivered to the sleeve or to the tub by way of the inflow section. To this end the dispensing tray preferably has at least one reservoir chamber which can be removed from the dispensing tray for filling with detergent, in particular can be withdrawn as a drawer from the dispensing tray. At the same time the dispensing tray thus constitutes a housing for the reservoir chamber for detergent arranged therein.

A vapor trap device is formed in a curved line segment in the inflow section. Formed in the line segment is a supply ventilation channel which opens to a first end of the line segment. At the first end said supply ventilation channel is separated from a delivery channel associated with the vapor trap device for delivering liquid medium from the dispensing tray to the tub. A line segment is therefore formed, in which case both the supply ventilation channel and also the delivery channel open at a first end and at said first end said two channels are also still formed separated from one another. Two different channels, which are also still configured separated from one another, are thus integrated in said line segment in an extremely compact and space-minimizing design. This means that a line segment having a connection at said first end is also generated which has two channels. The connection of two separate lines is no longer necessary, but a connection is effected quasi only by way of said one first end. A line segment is thus created which has an integrated multi-path system, wherein to this end a water intake system and an air channel system are implemented in one component. For this purpose, separate air and water paths are implemented at the front end. By this means a vapor trap is formed in the water intake which prevents the escape of vapor or condensate from a tub. In addition, a supply ventilation is achieved functionally through the warm process air in the region of the cold water feed to the dispensing tray. This brings about a temperature equalization and prevents any condensation of water. Effective prevention of vapor escaping from the filling device, which is formed by the tub and the drum, is achieved.

Provision is preferably made that the first end of the line segment is an upper end in terms of level. This means that the conceptual implementation of the vapor trap on the one hand and of the supply ventilation on the other hand can be achieved particularly reliably and a particularly simple capability for connection to the dispensing tray is ensured.

Provision is preferably made that the supply ventilation channel is formed circumferentially in sectors around the delivery channel at the first end. As no complete circuit is formed, a particularly mechanically stable design is also implemented and a particularly suitable positioning of the supply ventilation channel and of the delivery channel is also achieved. In particular, the supply ventilation can then be configured positionally quite specifically at said first end and take place in particularly precise and also airtight fashion at the transition into a dispensing tray and an extract ventilation channel there.

Provision is preferably made that the supply ventilation channel opens at a site of entry into the delivery channel, in which case in terms of level the site of entry lies above a liquid level in the delivery channel, wherein the vapor trap is formed.

Said site of entry is thus formed at the end of said supply ventilation channel facing away from the first end of the line segment and thus at a site displaced inwards in the line segment.

Provision is preferably made that the delivery channel has a flexible channel segment after the entry of the supply ventilation channel, in particular that said flexible channel segment is formed as a corrugated tube. As a result of such a design an otherwise in particular rigidly formed line segment or inflow section can experience a certain reversible deformability in order not to experience any damage in the event of the system moving during operation of the household appliance.

Provision is preferably made that the inflow section is formed as a single-part component in the form of the line segment itself, in particular as an injection molded part.

This filler hose or this line segment effects the connection of the filler arrangement with the dispensing tray and the detergent dosage to the tub. In this situation said line segment also serves the function of transporting the process water into the tub. On account of the dynamic movements of the washing unit or of the agitation system the motion compensation for said line segment is effected in particular by means of a flexible fold region or the already mentioned flexible channel segment.

As a result of the quite specific design of the line segment, said line segment simultaneously transports the heated process air to a condensation region in the dispensing arrangement. The special feature consists in the fact that the routing of air flow is integrated into the line segment but is transported by way of a channel course separate from the water path.

Transportation back by way of the water path is excluded as a result of the abovementioned water supply device. The throughflow cross section required for the routing of air flow is achieved in particular by an eccentric arrangement of a nozzle in the nozzle. By this means, a concept is enabled which not only fashions a particularly space-minimized and simple connection principle, but is also mechanically stable and robust.

The sealing of the inner and outer connection nozzles is advantageously achieved by means of specific sealing elements or sealing ribs. The hose connection can be additionally secured on the outer nozzle by means of suitable hose clips.

An exemplary embodiment of the invention will be described in detail in the following with reference to the schematic figures of the drawing. In the drawings:

The same elements or elements having the same function are identified by the same reference characters in the figures.

FIG. 1 shows a washing machine as a household appliance 1 through which water flows, which is designed for the care of laundry items. The household appliance 1 can however also be a washer-dryer.

Figure 1:
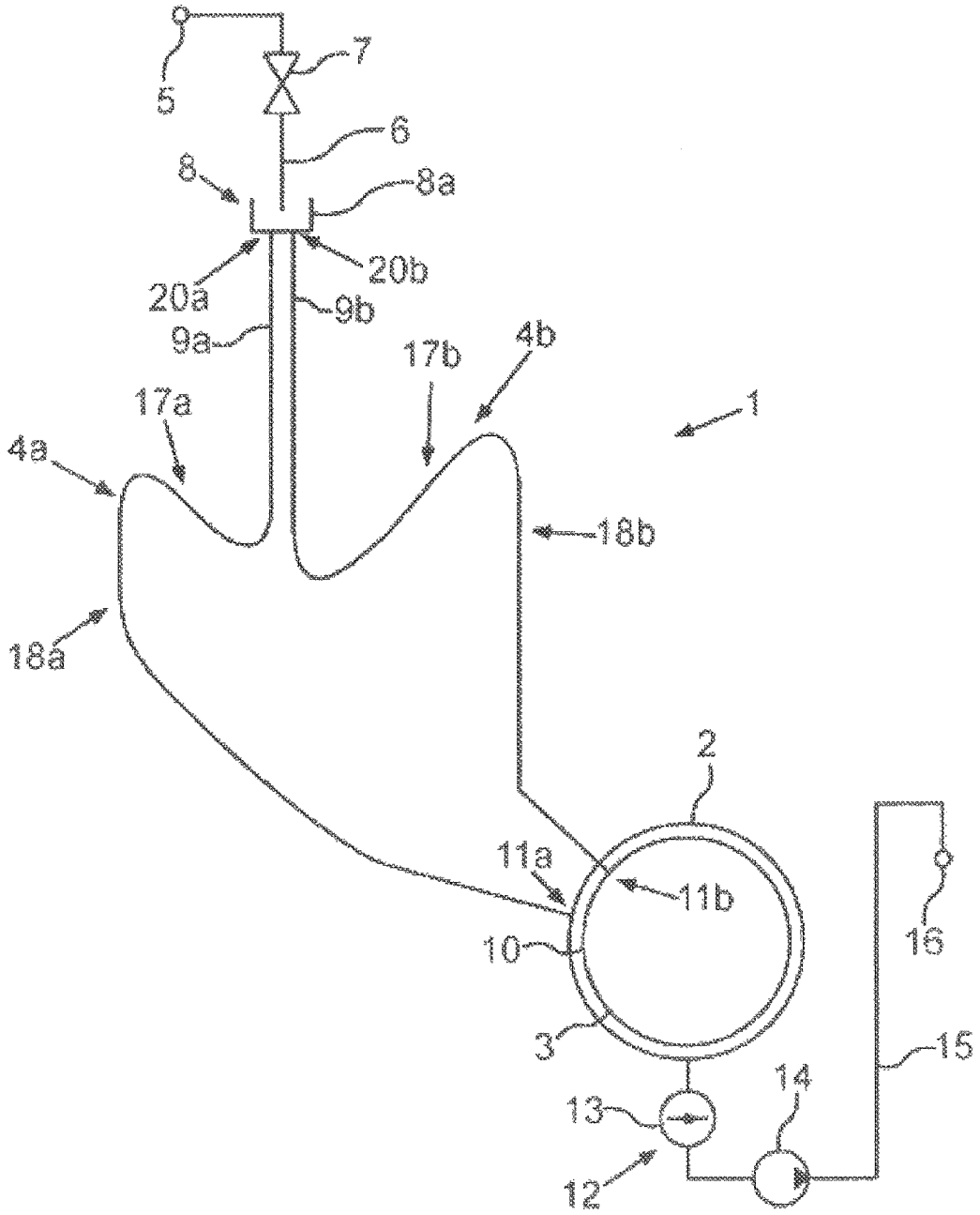
FIG. 1 shows a schematic illustration of an exemplary embodiment of a household appliance according to the invention.

The household appliance 1 has a tub 2, in which is arranged a drum 3 for receiving laundry items and is capable of rotation about an axis of rotation perpendicular to the plane of the figure.

In addition the household appliance 1 comprises a first inflow section 4*a*, by way of which fresh water can be guided into the drum 3. Furthermore, a connection 5 is designed which can be connected to a domestic installation or the like. A fresh-water line 6 leads from the connection 5 into the interior of the household appliance 1. Arranged in the fresh-water line 6 is a stop valve 7 which for example is controlled by a controller in accordance with an executed program. The fresh-water line 6 passes by way of a free air path into a dispensing tray 8*a* of a dispensing arrangement 8. In the dispensing tray 8*a* a laundry treatment agent, in particular a detergent, for example can be provided which is flushed by the fresh water through a line 9*a* of the inflow section 4*a*.

The household appliance 1 has a flexible sleeve 10 which is connected with the tub 2.

As can be seen from the illustration in FIG. 1, the first inflow section 4*a* opens by way of a first inflow point 11*a* into the tub 2. A pipe section of the inflow section 4*a* opens at said inflow point 11*a* into the tub 2. Fresh water and where applicable a mixture of fresh water and a laundry treatment agent can thus also be delivered into the drum 3 by way of the inflow section 4*a*.

The household appliance 1 moreover has pumping-away section 12 which comprises a flap valve 13, a drain pump 14 and a line 15. When the flap valve 13 is opened, detergent solution contained in the tub 2 can be pumped by actuating the drain pump 14 by way of the line 15 to an outlet 16. The outlet 16 can in this case be connected with a suitable drain of a domestic installation or the like.

A vapor trap device 17*a* is formed in the inflow section 4*a*. This is formed in a curved line segment 18*a* of the inflow section 4*a*. The vapor trap device 17*a* is formed by a water supply device.

As the illustration in FIG. 1 furthermore shows, the inflow section 4*a* opens into the tub 2 at the inflow point 11*a*, in which case at the other end the dispensing tray 8*a* of the dispensing arrangement 8 opens out at the entry 20*a*.

In addition, a second inflow section 4*b* is provided in the exemplary embodiment which likewise has a line segment 18*b* in which a curved upper segment is formed. A vapor trap device 17*b* is also configured here. By way of the line 9*b*, a connection is formed between the dispensing tray 8*a* and the further inflow section 4*b* by way of a further entry 20*b* into the dispensing tray 8*a*. The further inflow section 4*b* opens at the other end at an inflow point 11*b* into the sleeve 10 which is situated between the tub 2 and the drum 3.

Provision is made in the exemplary embodiment that the inflow section 4*b* is formed without a specific supply ventilation channel, as is provided in the case of the inflow section 4*a*.

The line segment 18*a* will be described in detail with reference to the following figures.

Figure 2:
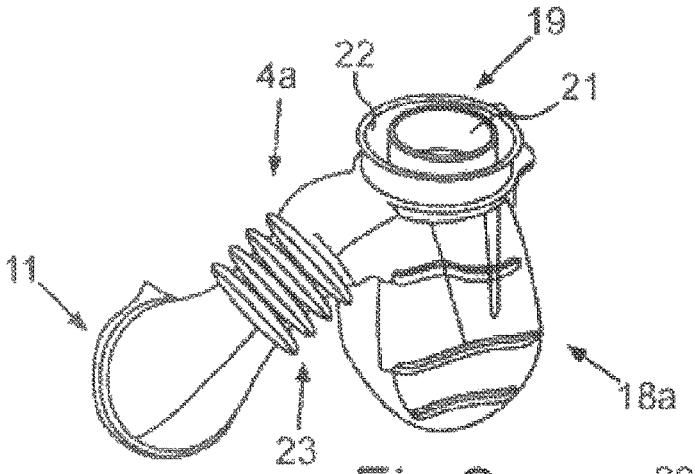
FIG. 2 shows a perspective view of an inflow section of a household appliance according to FIG. 1.

To this end FIG. 2 shows a perspective view of the inflow section 4*a* with the line segment 18*a*. The line segment 18*a* has a first upper end 19 which is connected with a connection nozzle 20 of the dispensing tray 8*a*. A delivery channel 21 and, separated therefrom, a supply ventilation channel 22 open into said upper first end 19. At said first end 19 said two channels 21 and 22 are configured with continuations opening thereinto for connection purposes and are furthermore separated from one another.

The line segment 18*a*, which constitutes the inflow section 4*a* in the exemplary embodiment, is a single injection molded part. It is predominantly rigid in design and has a flexible channel segment 23 only in a central segment, which is formed as a corrugated tube.

Figure 3:
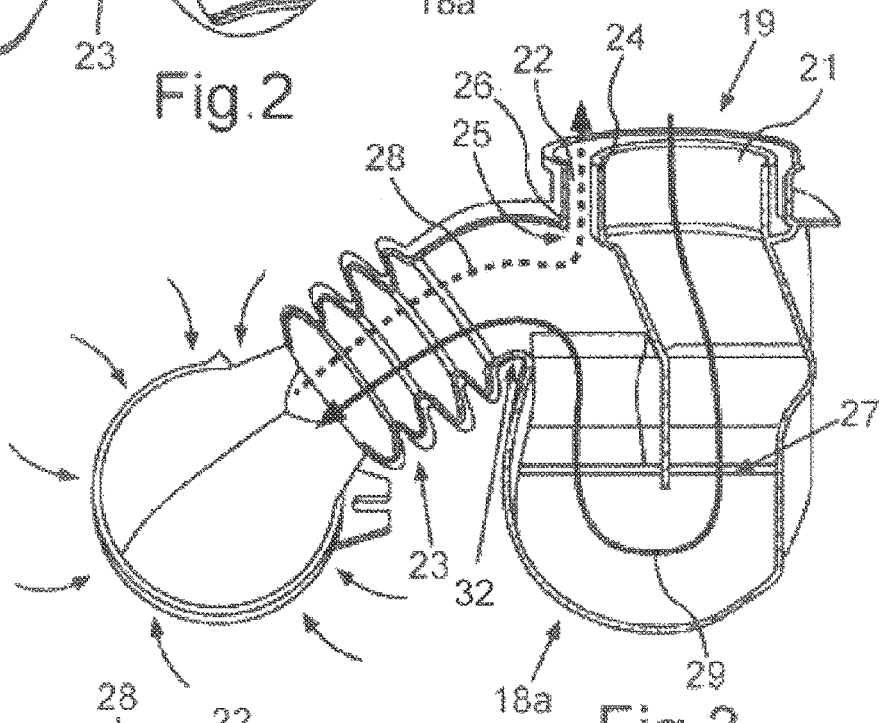
FIG. 3 shows a sectional view through the embodiment according to FIG. 2.

FIG. 3 shows a view of the line segment 18*a* according to FIG. 2 partially drawn as a sectional view. As can be seen from the illustrations in FIGS. 2 to 4, the supply ventilation channel 22 is formed not running completely circumferentially around the delivery channel 21 at said first end 19 but is configured to run circumferentially only in sectors in this respect. The supply ventilation channel 22 is separated from the delivery channel 21 by a delimiting wall 24.

As can be seen from the illustration in FIG. 3, the first end 19 is an upper end in terms of level with regard to the height situation.

The supply ventilation channel 22 opens into the delivery channel 21 formed in curved fashion with its lower end 25 facing away from the upper end 19.

A corresponding site of entry 26 is designed situated higher in terms of level than a liquid level 27 in the delivery channel 21. The vapor trap is formed by the design of a delimiting wall 24 and the liquid level 27 which extends above the lower end of the delimiting wall 24. Said liquid level 27 lies below the site of entry 26 in terms of level. The process air 28, which is represented by the corresponding arrow, can thus be transported away without difficulty by way of the inflow section 4*a* and the supply ventilation channel 22 into the dispensing tray 8*a*.

On the other hand, the liquid medium 29 in the form of the fresh water and where applicable an added detergent can be transported in accordance with the arrow illustration shown from the dispensing tray 8*a* by way of the line segment 18*a* formed as a curved pipe section as far as the inflow point 11*a*.

As can furthermore be seen in FIG. 3, the flexible channel segment 23 is formed in the delivery channel 21 and is thus arranged downstream of the site of entry 26 of the supply ventilation channel 22. As can furthermore be seen from FIG. 3, the site of entry 26 is also arranged above a kink region 32 of the delivery channel 21 in terms of level, in which case said kink region 32 is arranged following on from the bend in the delivery channel 21, in which bend the vapor trap is formed. Even if the liquid spills over said kink region 32 or if the liquid level 27 were to rise up to said kink point 32, the supply ventilation process is still always enabled without difficulty by way of the supply ventilation channel 22. Said supply ventilation channel 22 then, as already mentioned, opens into a supply ventilation channel (not shown in more detail) in the dispensing tray 8*a*, in which case the extract ventilation channel there is then routed such that it makes contact with a delimiting wall which delimits the volume region in which the liquid medium is contained.

This means that the process air is guided along a condensation region for as long as possible and then forwards again from the latter in order in particular to be able to then exit from the dispensing tray 8*a* on the front side.

Figure 4:
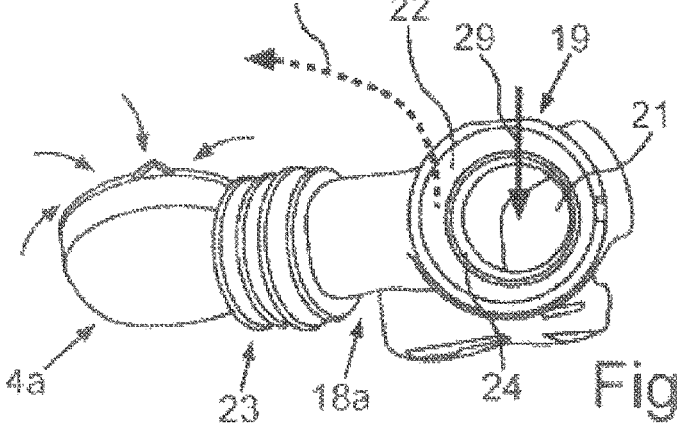
FIG. 4 shows a perspective top view of the embodiment according to FIG. 2 and FIG. 3.

FIG. 4 shows a perspective top view of the upper first end 19. The exit or opening region of the supply ventilation channel 22 formed in this illustration as an annular section can likewise be seen.

Figure 5:
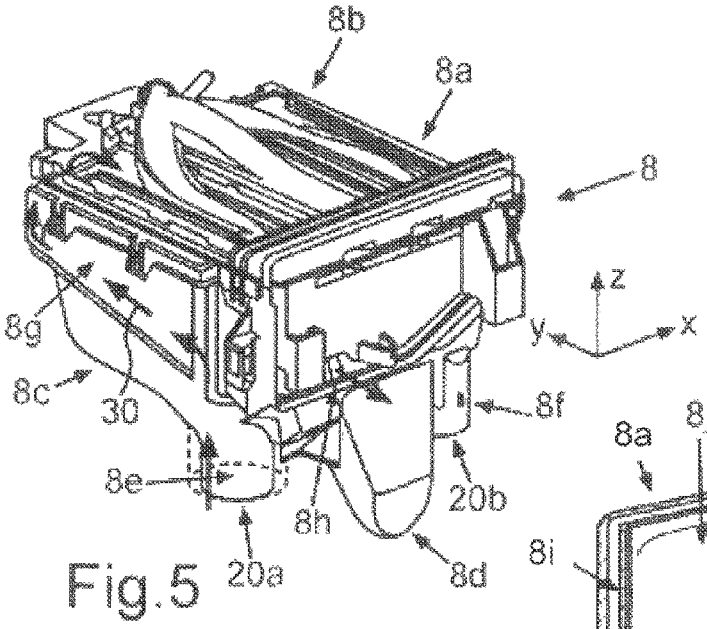
FIG. 5 shows a perspective view of an exemplary embodiment of a dispensing arrangement having a dispensing tray.

FIG. 5 shows a perspective view of an exemplary embodiment of the dispensing arrangement 8 with the dispensing tray 8*a*.

The dispensing tray 8*a* comprises an upper part 8*b* and a lower part 8*c* which are produced as separate parts, for example as single injection molded parts and can be connected with one another, for example can be locked.

In the dispensing tray 8*a*, a water inlet flow device 8*d* having a water-receiving depression is formed in the lower part 8*c*. In the present exemplary embodiment according to the illustration in FIG. 7, which shows a sectional view in the x-z plane, the water-receiving depression is a siphon.

Formed on the lower part 8*c* is an outflow connection 8*e* at which the line segment 18*a* can be connected by way of the line 9*a*.

At a further outflow connection 8*f*, which is integrated on the lower part 8*c*, the line segment 18*b* can then be connected by way of the line 9*b*.

As can furthermore be seen from the illustration in FIG. 5, an extract ventilation channel 8*g* is formed in the outflow connection 8*e* and in its further continuation, in which case the illustration is shown partially broken open here such that it is possible to see into the interior of the channel 8*g*. When the line segment 18*a* and the outflow connection 8*e* are in the connected state, the air is then guided by way of the supply ventilation channel 22 in accordance with the indicated arrow direction 30 into the extract ventilation channel 8*g* in the dispensing tray 8*a*. In this situation said air is guided from a front end of the dispensing tray 8*a*, at which the outflow connection 8*e* is formed, over the entire depth (y direction) towards the back, and from there towards the front again and blown out from the dispensing tray 8*a* by way of a front-side opening 8*h*.

Figure 6:
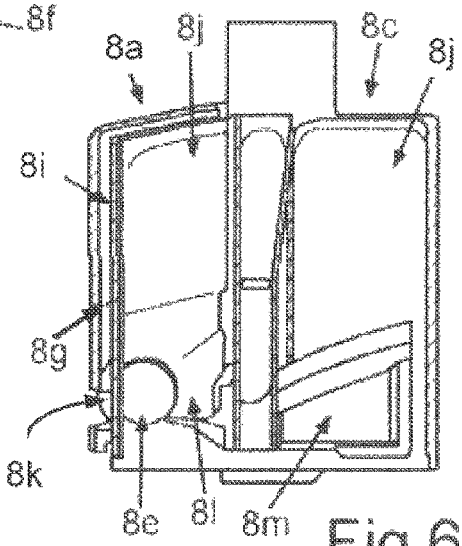
FIG. 6 shows a horizontal sectional view through the embodiment according to FIG. 5.

It can be seen from the illustration according to FIG. 6 that the very narrow extract ventilation channel 8*g* is delimited inwards by a delimiting wall 8*i*. Said wall 8*i* is at the same time also the delimiting wall of a water-receiving compartment 8*j* in the lower part 8*c*. The water situated therein, which may also contain a detergent, is then routed to the tub 2 by way of delivery channel 21.

As a result of the quite specifically designed and arranged ventilation channel 8*g* the air is guided along for as long as possible in the region of the water-receiving compartment 8*j* charged with the liquid which means that a corresponding condensation can take place.

The design of the dispensing tray 8*a* is moreover implemented such that in the lower part 8*c* a partial channel 8*k* is formed which with a further partial channel in the upper part 8*b* forms the closed complete extract ventilation channel 8*g*.

Provision is moreover made that the upper part 8*b* has a guide wall (not shown) by means of which, when the upper part 8*b* is in the assembled state with the lower part 8*c*, an interior space of the dispensing tray 8*a* is divided into two dispensing channels 8*l* and 8*m*. A first dispensing channel 8*m* is formed as a vapor trap with the water inlet flow device. A second dispensing channel 8*l* is formed as a connection to the tub 3 with a water inlet flow device.

Figure 7:
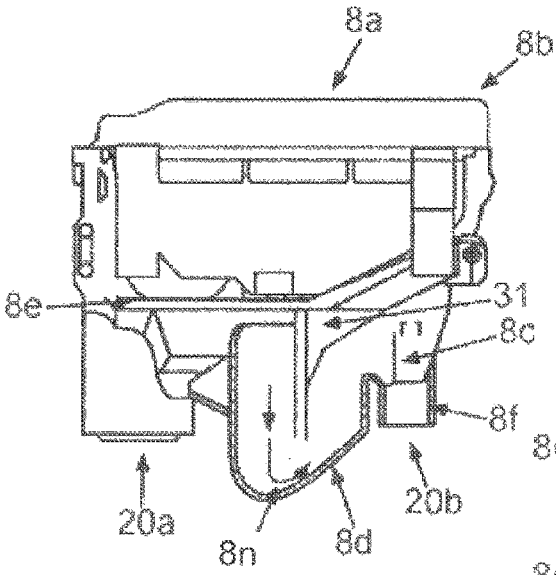
FIG. 7 shows a vertical sectional view through the embodiment according to FIG. 5.

The illustration in FIG. 7 which has already been mentioned shows the design of the water inlet flow device 8*d* formed as a siphon 8*n* and illustrated broken open. This is integrated in the lower part 8*c*.

In order to simplify production of the lower part 8*c* as a single injection molded part provision is firstly made that only the water depression is formed. In order to create the siphon a separating wall 31 is then produced and made available as a single-part separate component which can then be inserted into the lower part 8*c* in the region of the water depression, in particular can be positioned there in locking fashion. To this end, the already positioned end state of said separating wall 31 is shown in FIG. 7, by means of which the siphon-like configuration of the water depression of the water inlet flow device 8*d* then results and the flow path of the liquid medium is shown in accordance with the arrows shown in FIG. 7.

Figure 8:
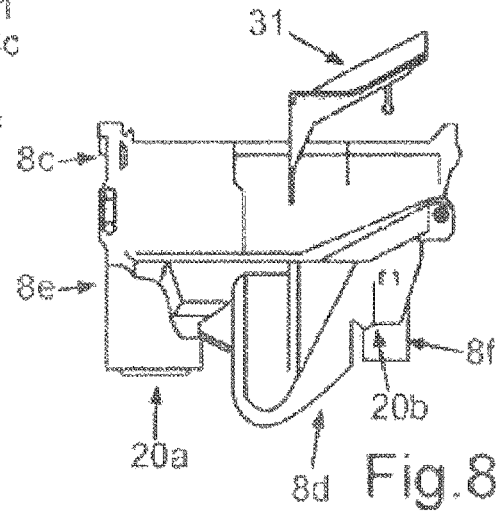
FIG. 8 shows a further illustration of the embodiment in FIG. 7.

To this end a side view is shown in FIG. 8 in which the separating wall 31 has been removed. With such a configuration of the dispensing tray 8*a*, a quite specific water supply system for the dispensing process is also formed which reliably prevents the escape of vapor from the tub 3 during the washing and drying operation. This is effected by way of the water supply in the integrated siphon 8*n* in the dispensing tray 8*a*.

When water is running from the dispensing tray 8*a* to the sleeve between the tub 2 and the drum 3, then the aforementioned water supply system is completely flooded. Water flows through the channel in this situation.

LIST OF REFERENCE CHARACTERS

1 Household appliance
2 Tub
3 Drum
4*a* Inflow section
4*b* Inflow section
5 Connection
6 Fresh-water line
7 Stop valve
8 Dispensing arrangement
8*a* Dispensing tray
8*b* Upper part
8*c* Lower part
8*d* Water inlet flow device
8*e* Outflow connection
8*f* Outflow connection
8*g* Extract ventilation channel
8*h* Opening
8*i* Delimiting wall
8*j* Water-receiving compartment
8*k* Partial channel
8*l* Dispensing channel
8*m* Dispensing channel
8*n* Siphon
9*a* Line
9*b* Line
10 Sleeve
11*a* Inflow point
11*b* Inflow point
12 Pumping-away section
13 Flap valve
14 Drain pump
15 Line
16 Outlet

17*a* Vapor trap device
17*b* Vapor trap device
18*a* Line segment
18*b* Line segment
19 First upper end
20*a* Entry
20*b* Entry
21 Delivery channel
22 Supply ventilation channel
23 Channel segment
24 Delimiting wall
25 Lower end
26 Site of entry
27 Liquid level
28 Process air
29 Medium
30 Arrow direction
31 Separating wall
32 Kink region

The invention claimed is:

1. A dispensing arrangement for a household appliance for the care of laundry items, having a dispensing tray which has a lower part, wherein a water inlet flow device having a water-receiving depression is formed in the lower part, and an outflow connection opening into the water-receiving depression is formed on the lower part, the outflow connection including an end configured for direct connection to a line segment extending away from the dispensing tray, wherein the lower part has a partial channel, forming part of an extract ventilation channel by which process air received from the line segment is vented exterior to the dispensing tray, wherein the partial channel extends from the end of the outflow connection and is delimited by a wall which is also a delimiting wall of a water-receiving compartment of the dispensing tray.

2. The dispensing arrangement as claimed in claim 1, wherein the dispensing tray has an upper part which can be connected or is connected with the lower part.

3. The dispensing arrangement as claimed in claim 2, wherein the partial channel is closed by a second partial channel in the upper part when the lower part is connected with the upper part.

4. The dispensing arrangement as claimed in claim 2, wherein the extract ventilation channel is routed exterior to the water receiving compartment, from a front end of the lower part, at which the outflow connection is arranged, to a rear end of the lower part and upwards into the upper part and is routed from there again to an opening of the front end into a discharge opening.

5. The dispensing arrangement as claimed in claim 2, wherein the upper part has a guide wall, by means of which, when the upper part is in the assembled state with the lower part, the interior space of the dispensing tray is divided into two dispensing channels.

6. The dispensing arrangement as claimed in claim 5, wherein a first dispensing channel is formed with the water inlet flow device as a vapor trap.

7. The dispensing arrangement as claimed in claim 5, wherein a second dispensing channel is formed with the water inlet flow device as a connection to a tub of the household appliance.

8. The dispensing arrangement as claimed in claim 1, wherein the partial channel is essentially formed over the entire length of the water-receiving compartment of the dispensing tray in the lower part.

9. The dispensing arrangement as claimed in claim 1, wherein a separating wall separate from the lower part is formed, which can be fitted to the lower part, and in the disposed state of the separating wall a siphon is formed between the outflow connection and a water-receiving compartment in the lower part.

10. The dispensing arrangement as claimed in claim 1, wherein the partial channel extends along a portion of a perimeter of the dispensing tray, exterior and isolated from the water receiving compartment.

11. The dispensing arrangement as claimed in claim 1, wherein the partial channel, in its entirety, is isolated from the water receiving compartment.

12. The dispensing arrangement as claimed in claim 1, wherein the delimiting wall isolates the partial channel from the water receiving compartment, so as to allow process air to be channeled exterior to the water receiving compartment.

13. A household washing machine for the care of laundry items having a drum and the dispensing arrangement as claimed in claim 1, wherein the line segment is configured to convey process air from the drum to the partial channel of the lower part, for venting exterior to the dispensing tray.

* * * * *